US008057289B1

(12) United States Patent
Burgess

(10) Patent No.: US 8,057,289 B1
(45) Date of Patent: Nov. 15, 2011

(54) DIGITAL GRAPHIC GROUND SLOPE DISPLAY FOR GOLF GAMES

(76) Inventor: Stephen David Burgess, Fulshear, TX (US)

( * ) Notice: Subject to any disclaimer, the term of this patent is extended or adjusted under 35 U.S.C. 154(b) by 403 days.

(21) Appl. No.: 12/400,584

(22) Filed: Mar. 9, 2009

Related U.S. Application Data

(60) Provisional application No. 61/127,290, filed on May 12, 2008.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl. ..... 463/2; 463/16

(58) Field of Classification Search ..... 463/2, 16
See application file for complete search history.

(56) References Cited

U.S. PATENT DOCUMENTS 7,270,601 B2 * 9/2007 Takahashi et al. ..... 463/3

OTHER PUBLICATIONS

Golden Tee® Live, Copyright 2006 Incredible Technologies, Inc.*

* cited by examiner

*Primary Examiner* — Jarrett Stark
(74) *Attorney, Agent, or Firm* — Buskop Law Group, PC; Wendy Buskop

(57) ABSTRACT

A system for use with a video of a golf game containing images of the ground, wherein the system comprises a source, a processor, data storage with computer instructions in communication with the processor and a digital display to assist in predicting an outcome for each golf shot.

11 Claims, 4 Drawing Sheets

DIGITAL GRAPHIC GROUND SLOPE DISPLAY FOR GOLF GAMES

CROSS REFERENCE TO RELATED APPLICATIONS

The present application claims priority to co-pending U.S. Provisional Application Ser. No. 61/127,290 filed on May 12, 2008, entitled "Digital Graphic Artificial Horizon Display" and is incorporated in its entirety herein.

FIELD

The present embodiments generally relate to a system for use with a golfing live or stored video, using a video source, a processor, data storage with computer instructions in communication with the processor and a digital display that displays an earth level and a ground slope of a ball assisting a viewer to predict individual golf shot outcomes.

BACKGROUND

Golfing competitions tend to become boring for viewers and difficult for a casino to use as a revenue stream.

A need exists for a method for wagering on golf games that makes the golf games more fun, and requires some skill and understanding by a viewer of the ground slope as compared to the earth level for each shot of a golf game.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus and system in detail, it is to be understood that the apparatus and system are not limited to the particular embodiments and that it can be practiced or carried out in various ways.

The present embodiments relate to a system for use with a video of a golf game containing images of the ground and a golf ball.

The system can use a video source, a processor, data storage with computer instructions in communication with the processor and a digital display to show ground slope variables for individual golf shots so that a viewer can make wagers on the outcome of individual golf shots.

The present embodiments were conceived to enable a viewer in real time to observe golf balls and compare the location of each golf ball to the slope of the ground, herein termed "ground slope" where the ball lies.

The embodiments can also provide a means for wagering on golf games that is more interesting than anything out in casinos today.

Figure 1:
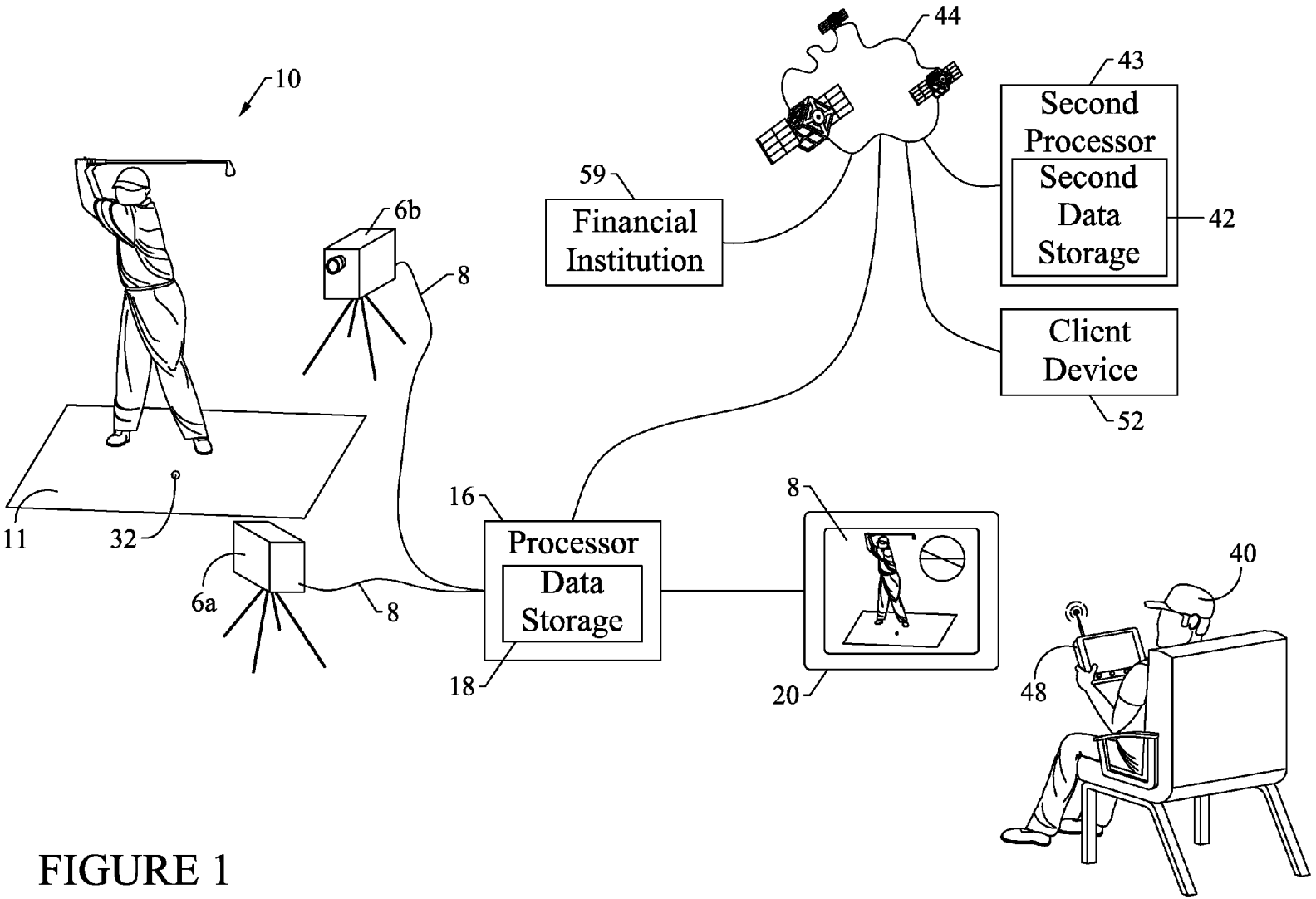
FIG. 1 is a schematic of the system of the embodiments.

Turning now to the Figures, FIG. 1 shows a schematic of the system of the invention.

FIG. 1 depicts a video 8 of a golf game 10.

The video 8 of a golf game 10 can be a real time video, such as a golf channel feed, a network broadcast or cable broadcast. The video 8 can be a stored video, a RSS feed, a U-Tube video, hacker vides, amateur video, a PGA video, or similar types of videos.

The video 8 can have images of ground 11 throughout the video.

Figure 2:
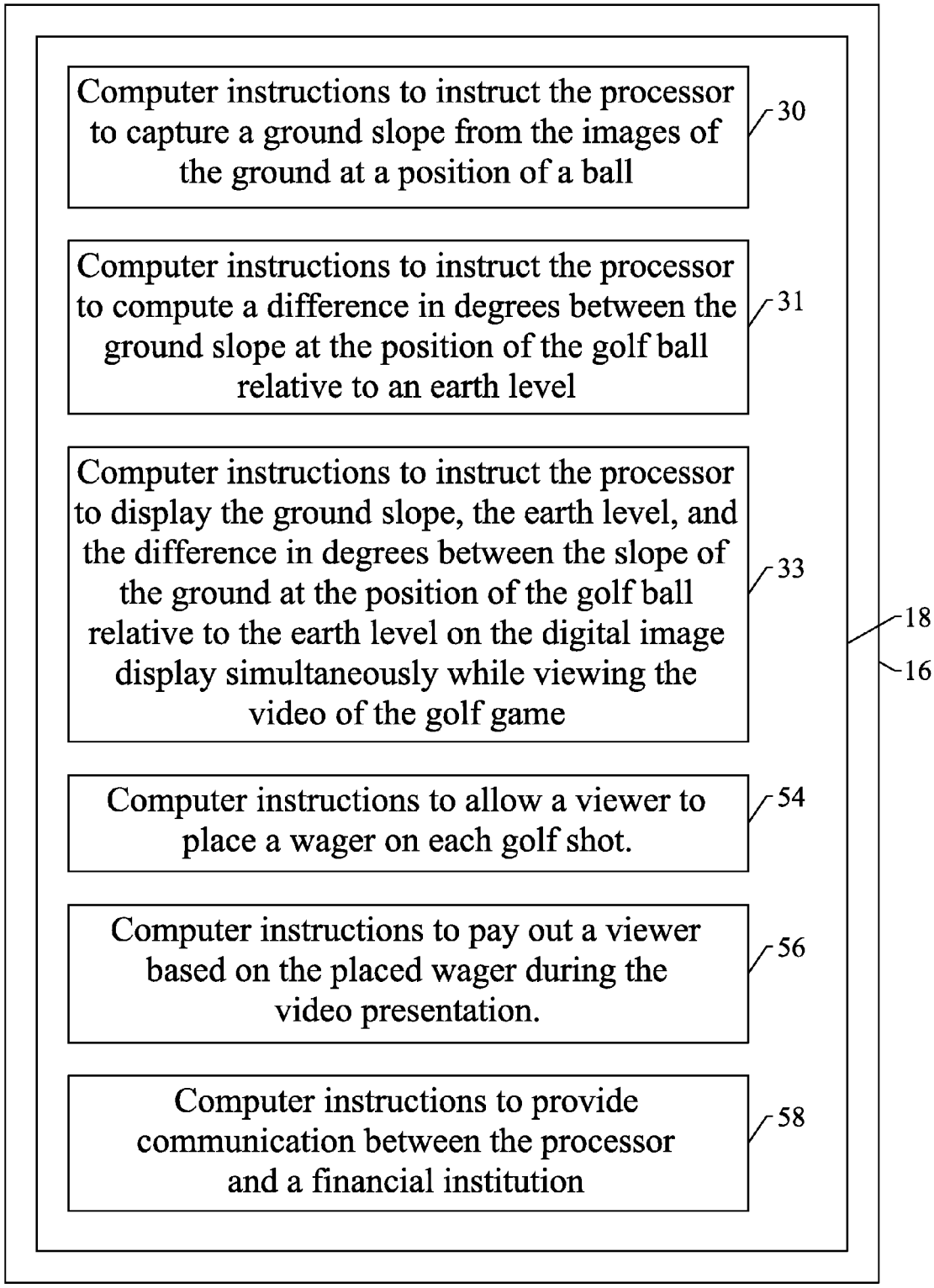
FIG. 2 depicts the computer instructions usable with a processor in communication with the data storage according to the invention.
Figure 3:
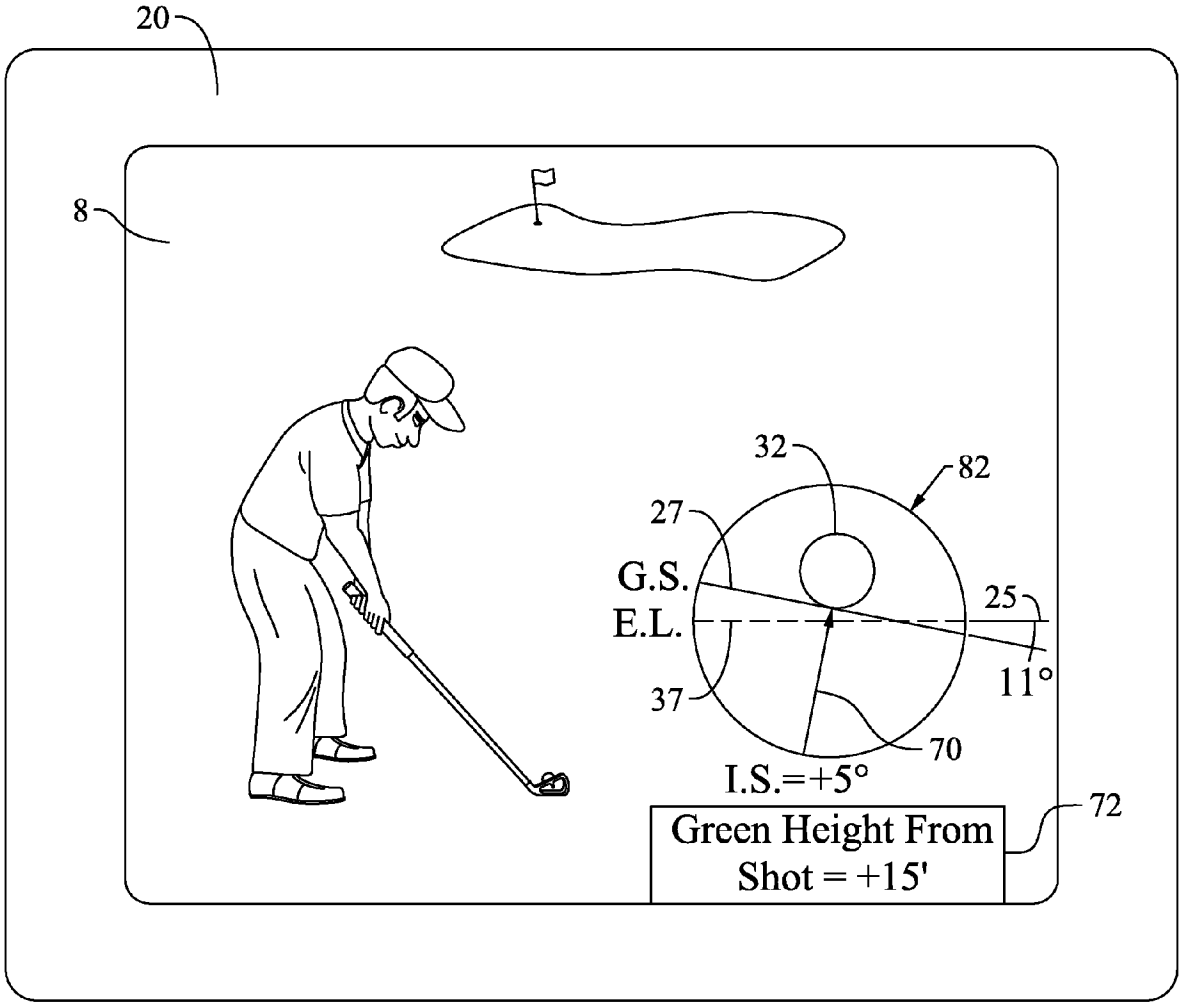
FIG. 3 depicts the digital image display of the invention for presenting video images of a golfer depicting the earth level and the ground slope.

The processor can use computer instructions 30 in the data storage 18, which are shown in FIG. 2, to instruct the processor 16 to capture a ground slope 27, which is shown in detail in FIG. 3, of the images of the ground 11 at a position of a golf ball 32.

Additionally, computer instructions 31 in the data storage 18 shown also in FIG. 2, can instruct the processor 16 to compute a difference in degrees 25 between the ground slope 27 at the position of the golf ball 32 relative to an earth level 37 which is shown in FIG. 3.

"Ground slope" 27 can be defined herein as a horizontal plane parallel to the surface of the earth.

Computer instructions 33 in the data storage 18, also shown in FIG. 2, can instruct the processor 16 to display the ground slope 27, the earth level 37, and the difference in degrees 25 between the slope of the ground at the position of the ball relative to the earth level on the digital image display simultaneously while viewing the video of the golf game.

The system can allow the computer to present for each golf shot taken in the video, information that can allow a viewer to wager, such as place bets on the accuracy for individual golf shots.

The term "ground slope" can be a plane parallel to the surface of the ground shown in the video. The ground slope can be made of the longitudinal and transverse slope of the ground at a certain ball's position. The viewer needs to know not only the lateral slope of the ground, but inline slope of the terrain also.

The video 8 can be transmitted to a processor 16 such as a computer, a lap top, such as a Dell laptop, a Mac Book Air™, a server on a network, a cell phone with the application loaded on the processor of the cell phone, an I-pod™, or other personal digital assistant capable of processing video signals.

The processor 16 can communicate integrally, remotely or both, with data storage 18, which can be in communication with the processor. The data storage 18 can be a removable hard drive, a flash drive, or another similar data storage device that can be capable of storing video.

A digital image display 20 can be in communication with the processor 16. The digital image display 20 can be a monitor, an LCD display, a cell phone display, a personal digital assistant "PDA" display, an I-pod™ display, a DVD display, a display of a slot machine, another digital image display capable, or combinations thereof for presenting video of the golf game for viewing by a viewer 40.

FIG. 1 also shows two sources, source 6*a* and 6*b* which can be two video cameras covering a golfer making a shot.

FIG. 1 also shows that the processor 16 can be communicating with at least one network 44, which can be a cell network, satellite network, LAN, the Internet, another wireless network or another similar network.

A second processor 43 with a second data storage 42 can hold videos that can be transmitted to the first processor, such as through a network 44.

The network 44 can also provide communication with a financial institution 59 and the processor 16 so that a user can place a wager, using money, such as Caesar's casino.

A client device 52, such as a home computer can communicate with the network for home based casino gaming.

FIG. 1, further depicts an executive dashboard 48, which can be connected via a network 44 communicating with a client device 52 for the viewer 40.

FIG. 2 depicts computer instructions in a data storage 18, which can be in communication with a processor 16.

FIG. 2 shows computer instructions 30 in the data storage 18, which can instruct the processor 16 to capture a ground slope 27 of the images of the ground 11 at a position of a golf ball 32.

FIG. 2 also shows computer instructions 31 in the data storage 18, which can instruct the processor 16 to compute a difference in degrees 25, as shown in FIG. 3, between the ground slope 27 at the position of the golf ball 32, as shown in FIG. 1, relative to an earth level 37, also shown in FIG. 3.

For example, the processor can use the attitude of the earth level for the image as zero. A cameraman or similar video operator can target a golf ball in the video.

The video operator can focus on the ball, and send a signal to the processor 16 to compute the ground slope at the position of the golf ball.

The processor uses computer instructions 33 in the data storage 18, which can instruct the processor 16 to display the ground slope 27, the earth level 37, and the difference in degrees 25 between the slope of the ground at the position of the golf ball relative to the earth level on the digital image display simultaneously while viewing the video of the golf game.

FIG. 2 also shows computer instructions 54, which can allow a viewer to place a wager on each golf shot. For example, a user can bet $2.00 for a golfer to hole (or make) a 20 foot put at Pebble Beach's hole 1.

FIG. 2 also shows computer instructions 56, which can pay out a viewer based on the placed wager during the video presentation. For example, given the example above, the instructions can pay out the viewer based on who the golfer is, the wind and rain and other weather conditions at Pebble Beach, historical information on the golfer, and difficulty of the golf shot, that is, the more severe the ground slope. The more difficult the shot, at certain odds, like 2:1 for Tiger Woods, can pay 5:1 for V. J. Singh for a similar shot.

FIG. 2 shows computer instructions 58, which can provide communication between the processor 16 and a financial institution 59, which is shown in FIG. 1.

In another embodiment, computer instructions 30 can instruct the processor 16 to continuously display the earth level 37 while the video 8 plays.

FIG. 3 shows the digital image display 20 with the video 8 of the golfer and a circular gauge 82 with the earth level 37 and the ground slope 27 and the difference in degrees 25 between the two. Additionally, a golf ball 32 is also shown in this Figure.

It can also be contemplated that the inline slope 70 can be shown on the circular gauge 82 along with the earth level 37, the ground slope 27 and the difference in degrees 25 between the two. Additionally, a green height 72 relative to the current shot being played can be also be shown.

An embodiment of the system can be usable with gaming devices, such as slot machines, a sports book with at least one live video monitor, and on-line casinos.

In an embodiment, it can also be contemplated that multiple videos of the competitions can be provided simultaneously to the viewer for multiple betting simultaneously.

The source 6*a*, 6*b* can be a digital video capture device, a live video capture device, multiple live cameras covering multiple golfers and combinations thereof.

The video of the golf game 10 can be a live video feed, a RSS feed, stored video programming, animated video programming, video programming created using an artificial intelligence program using random generated variables, or combinations thereof.

An example of a live video feed can be from a PGA golf game going on at the moment the viewer 40 is looking at the digital image display.

In an embodiment, the processor can have a second data storage which can contain a digital video capture device, a live video capture device, and combinations thereof.

The processor can further be a server or a combination of servers connected in series with a network, or combinations thereof.

An example of the source can be a digital camera. An example of a live video capture device can be a webcam.

The first and second data storage can be the same kind of data storage device or can be different kinds of data storage devices. Some examples of data storage devices can be a jump drive, flash memory, memory, or another data storage device capable of storing video.

Figure 4:
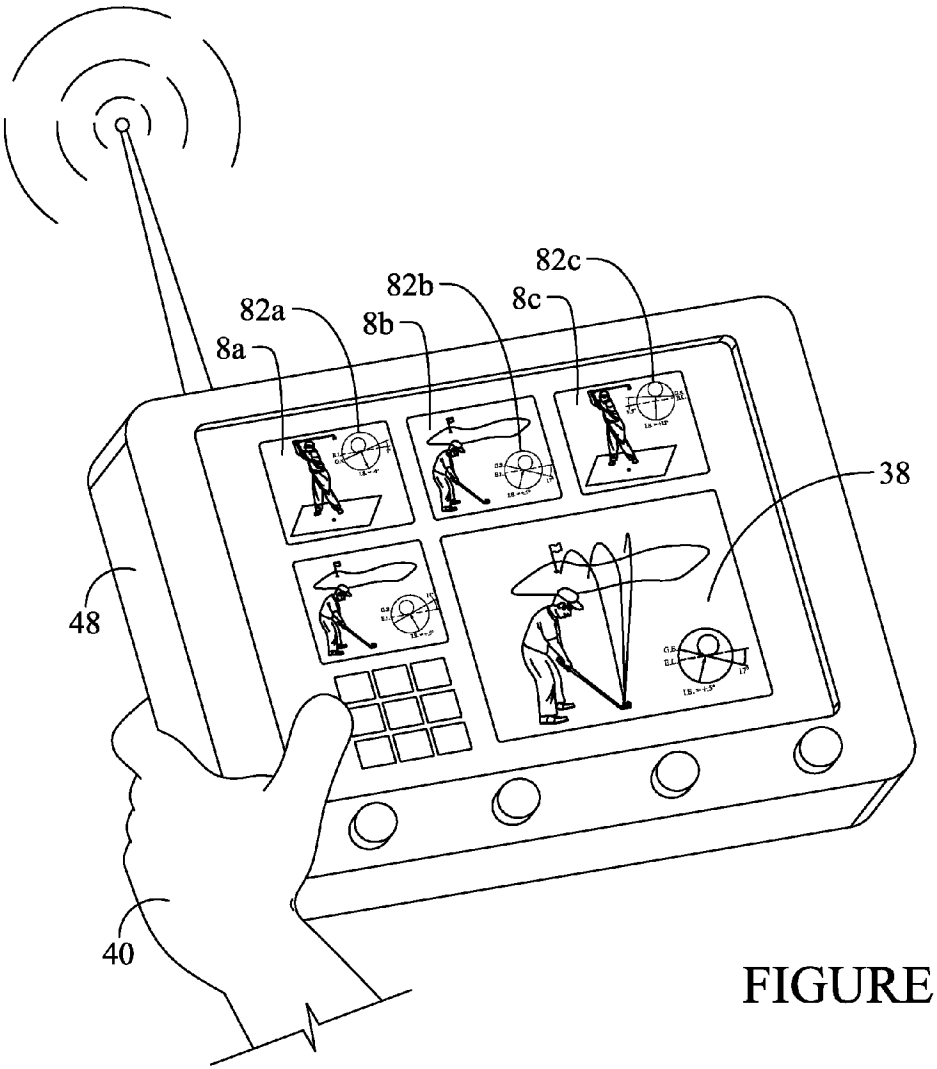
FIG. 4 depicts an executive dashboard showing thumbnails of holes by golfer and the earth level and the ground slope and results.

FIG. 4 depicts a detailed view of an executive dashboard 48, which can be connected via a network 44 communicating with a client device 52 for the viewer 40.

The executive dashboard can be connected either wirelessly or wired to a network 44, as shown in FIG. 1, which can be in communication with the client device 52 of the viewer 40.

FIG. 4 shows a circular gauge 82*a*, 82*b*, 82*c* with a video 8*a*, 8*b*, 8*c* for each golf shot in each video presented continuously and live, while the golf competition and/or video is occurring. The executive dashboard can enable a viewer to save each golf shot so that the viewer at any time can look at all the historical data for a particular golfer.

FIG. 4 further shows the variables for each golf shot 38, which can be displayed as accuracy of a golf shot.

In an embodiment, the computer instructions for wagering can further calculate golf odds of how close a golfer will hit a golf ball near the hole, which can be determined by the combination of the distance, ground elevation variation, and environmental variables (such as wind speed and direction, and temperature) of each particular golf shot.

The horizontal distance for any shot can be retrieved from the PGA's/LPGA's Shotlink™ in real time. The environmental variables can be retrieved from local weather databases in real time. The ground slope can be determined by the system in real time.

The odds that the golf ball will be struck into the hole on any particular shot by any particular golfer can be calculated by the system by utilizing the combination of the distance, environmental variables, and ground slope for each golf shot.

The odds that the golf ball will be struck into the hole on any particular shot by any particular golfer can be adjusted utilizing the Shotlink™ database for any particular golfer for the past statistics of his/her performance on golf shots with similar variables to the current shot variables in real time.

The odds of how close the golf ball will be struck to the hole on any particular shot by any particular golfer can be adjusted utilizing the Shotlink™ database for any particular golfer for the past statistics of his/her performance on golf shots with similar variables to the current shot variables in real time.

While these embodiments have been described with emphasis on the embodiments, it should be understood that within the scope of the appended claims, the embodiments might be practiced other than as specifically described herein.

What is claimed is:

1. A system for use with a video of a live golf game with a ball, wherein the system comprising:

a. a source providing video of the live golf game containing images of the ground;

b. a processor in communication with the source;

c. data storage in communication with the processor;

d. a digital image display in communication with the processor for presenting the video of the live golf game;

e. computer instructions in the data storage to instruct the processor to capture a ground slope of the images of the ground at a position of a ball;

f. computer instructions in the data storage to instruct the processor to compute a difference in degrees between the ground slope at the position of the ball relative to an earth level; and g. computer instructions in the data storage to instruct the processor to display the ground slope, the earth level, and the difference in degrees between the slope of the ground at the position of the ball relative to the earth level on the digital image display simultaneously while displaying the video of the live golf game.

2. The system of claim 1, wherein the source is a video camera at the live golf.

3. The system of claim 1, wherein the processor is a laptop, a cell phone, another personal digital device, a computer, a server, a combination of processors connected in series with a network, or combinations thereof.

4. The system of claim 1, wherein the data storage is a jump drive, flash memory, memory, or another data storage device capable of storing video.

5. The system of claim 1, wherein the digital image display is a monitor, an LCD display, a cell phone display, an I-pod™ display, a DVD display, a display of a slot machine, or another digital image display capable of presenting video.

6. The system of claim 5, wherein the ground slope shown in a circular gauge comprises the earth level contained within in the circular gauge and the icon on a per shot basis reveals graphically a difference in slope between the ground slope and the earth level and the difference is displayed on the digital display and the earth level is tangent to the gravitational force field of planet earth.

7. The system of claim 6, wherein the circular gauge and variable golf shot are presented in sequence as an executive dashboard connected via a network communicating with a client device for the viewer.

8. The system of claim 1, wherein the video comprises a live video feed, an RSS feed, stored video programming, animated video programming, or combinations thereof.

9. The system of 1, further comprising computer instructions for wagering and computer instructions for paying out wagering to a viewer and computer instructions providing communications to at least on financial institution via a network.

10. The system of claim 9, wherein the computer instructions for wagering and computer instructions for paying out wagering are used with a slot machine, a sports book with at least one live video monitor, an on-line casino, or combinations thereof.

11. The system of claim 10, wherein a plurality of videos are provided simultaneously to the viewer for multiple betting simultaneously.

* * * * *